US005982401A

United States Patent [19]

Fassler et al.

[11] Patent Number: 5,982,401

[45] Date of Patent: Nov. 9, 1999

[54] MICROFLUIDIC PRINTING WITH CONTROLLED DENSITY

[75] Inventors: Werner Fassler; Xin Wen, both of Rochester; Charles D. Deboer, Palmyra, all of N.Y.

[73] Assignee: Eastman Kodak Company, Rochester, N.Y.

[21] Appl. No.: 08/943,105

[22] Filed: Oct. 3, 1997

[51] Int. Cl.[6] ..... B41J 2/005

[52] U.S. Cl. ..... 346/140.1

[58] Field of Search ..... 346/140.1; 347/6, 347/7

[56] References Cited

U.S. PATENT DOCUMENTS

| | | | |
|---|---|---|---|
| 5,450,111 | 9/1995 | Mutoh | 347/78 |
| 5,473,350 | 12/1995 | Mader et al. | 347/7 |
| 5,585,069 | 12/1996 | Zanzucchi et al. . | |
| 5,593,838 | 1/1997 | Zanzucchi et al. . | |
| 5,603,351 | 2/1997 | Cherukuri et al. . | |
| 5,611,847 | 3/1997 | Guistina et al. . | |
| 5,745,128 | 4/1998 | Lam et al. | 346/140.1 |

OTHER PUBLICATIONS

"Electroosmosis: A Reliable Fluid Propulsion System for Flow Injection Analysis", Anal. Chem. 66, pp. 1792–1798 (1994).

*Primary Examiner*—N. Le
*Assistant Examiner*—Lamson D. Nguyen
*Attorney, Agent, or Firm*—Raymond L. Owens

[57] ABSTRACT

A microfluidic printing system for delivering ink to a receive including at least one ink reservoir, a structure defining a plurality of chambers arranged so that the chambers from an array with each chamber being arranged to form an ink pixel for delivery to the receiver, and a plurality of microchannels connecting the reservoir to the chambers. The printing system further includes a plurality of microfluidic pumps each being associated with a single microchannel for supplying ink from an ink reservoir through a microchannel for delivery to a particular chamber. The system is responsive to the flow of the ink through the chambers to determine the amount of ink being delivered to a receiver through the chambers, and further controls the microfluidic pumps to prevent the further flow of ink to the receiver.

2 Claims, 4 Drawing Sheets

MICROFLUIDIC PRINTING WITH CONTROLLED DENSITY

CROSS REFERENCE TO RELATED APPLICATIONS

The present invention is related to U.S. patent application No. 08/868,426 filed Jun. 3, 1997, entitled "Continuous Tone Microfluidic Printing" to DeBoer, Fassler and Wen; U.S. patent application Ser. No. 08/868,416 filed Jun. 3, 1997 entitled "Microfluidic Printing on Receiver", to DeBoer, Fassler and Wen; U.S. patent application Ser. No. 08/868,102 filed Jun. 3, 1997 entitled "Microfluidic Printing with Ink Volume Control" to Wen, DeBoer and Fassler; U.S. patent application Ser. No. 08/868,477 filed Jun. 3, 1997 entitled "Microfluidic Printing with Ink Flow Regulation" to Wen, Fassler and DeBoer, all assigned to the assignee of the present invention. The disclosure of these related applications is incorporated herein by reference.

FIELD OF THE INVENTION

The present invention relates to printing high quality images by microfluidic pumping of inks into receivers such as paper by controlling the amount of ink.

BACKGROUND OF THE INVENTION

Microfluidic pumping and dispensing of liquid chemical reagents is the subject of three U.S. Pat. Nos. 5,585,069, 5,593,838, and 5,603,351, all assigned to the David Sarnoff Research Center, Inc. The system uses an array of micron sized reservoirs, with connecting microchannels and reaction cells etched into a substrate. Electrokinetic pumps comprising electrically activated electrodes within the capillary microchannels provide the propulsive forces to move the liquid reagents within the system. The electrokinetic pump, which is also known as an electroosmotic pump, has been disclosed by Dasgupta et al., see "Electroosmosis: A Reliable Fluid Propulsion System for Flow Injection Analysis", Anal. Chem. 66, pp 1792–1798 (1994). The chemical reagent solutions are pumped from a reservoir, mixed in controlled amounts, and them pumped into a bottom array of reaction cells. The array may be decoupled from the assembly and removed for incubation or analysis. When used as a printing device, the chemical reagent solutions are replaced by dispersions of cyan, magenta, and yellow pigment, and the array of reaction cells may be considered a viewable display of picture elements, or pixels, comprising mixtures of pigments having the hue of the pixel in the original scene. When contacted with paper, the capillary force of the paper fibers pulls the dye from the cells and holds it in the paper, thus producing a paper print, or photograph, of the original scene. One problem with this kind of printer is the accurate control of the print density. The problem comes about because the capillary force of the paper fibers is strong enough to remove all the ink from the device, draining it empty. If the paper is not removed from contact with the ink cells at the correct time, too much or too little ink will be delivered to the receiver and the print density of the image will be too high or too low. In addition, too much ink may result in bleeding together of the colors, resulting in muddy or inaccurate hues as well as blurred or unsharp images. Moreover, the correct paper contact time varies with the ambient temperature, making the timing problem more difficult. One solution to this problem is given in the above mentioned copending application entitled "Microfluidic Printing on Receiver", where a special paper is employed which will absorb only a limited amount of ink. It would be desirable to employ plain paper for this kind of printing.

SUMMARY OF THE INVENTION

It is an object of the present invention to accurately determine the amount of ink in an ink pixel delivered to a receiver by a microfluidic printing system.

Another object of this invention is to regulate a microfluidic printing system to control the flow of ink to a receiver to print colored pixels of the correct density.

These objects are achieved by a microfluidic printing system for delivering ink to a receiver comprising:

a) at least one ink reservoir;

b) a structure defining a plurality of chambers arranged so that the chambers form an array with each chamber being arranged to form an ink pixel for delivery to the receiver;

c) a plurality of microchannels connecting the reservoir to the chambers;

d) a plurality of microfluidic pumps each being associated with a single microchannel for supplying ink from an ink reservoir through a microchannel for delivery to a particular chamber;

e) means responsive to the flow of the ink through the chambers to determine the amount of ink being delivered to a receiver through the chambers; and f) means coupled to the ink flow responsive means for controlling the microfluidic pumps to prevent the further flow of ink to the receiver.

ADVANTAGES

A feature of the present invention is that it provides system which produces high quality prints of the correct density on receiver media such as plain paper by delivering the correct amount of ink in each pixel.

Another feature of the invention is that the ink flow is regulated without using moving mechanical components.

DETAILED DESCRIPTION OF THE INVENTION

The present invention is described in relation to a microfluidic printing system which can print computer generated images, graphic images, line art, text images and the like, as well as continuous tone images. In addition to the inks that are used for microfluidic printing of images, the system can also be used with other types of fluids useful in the graphic arts industry, such as special inks that can be used to directly write a lithographic printing plate.

Figure 1:
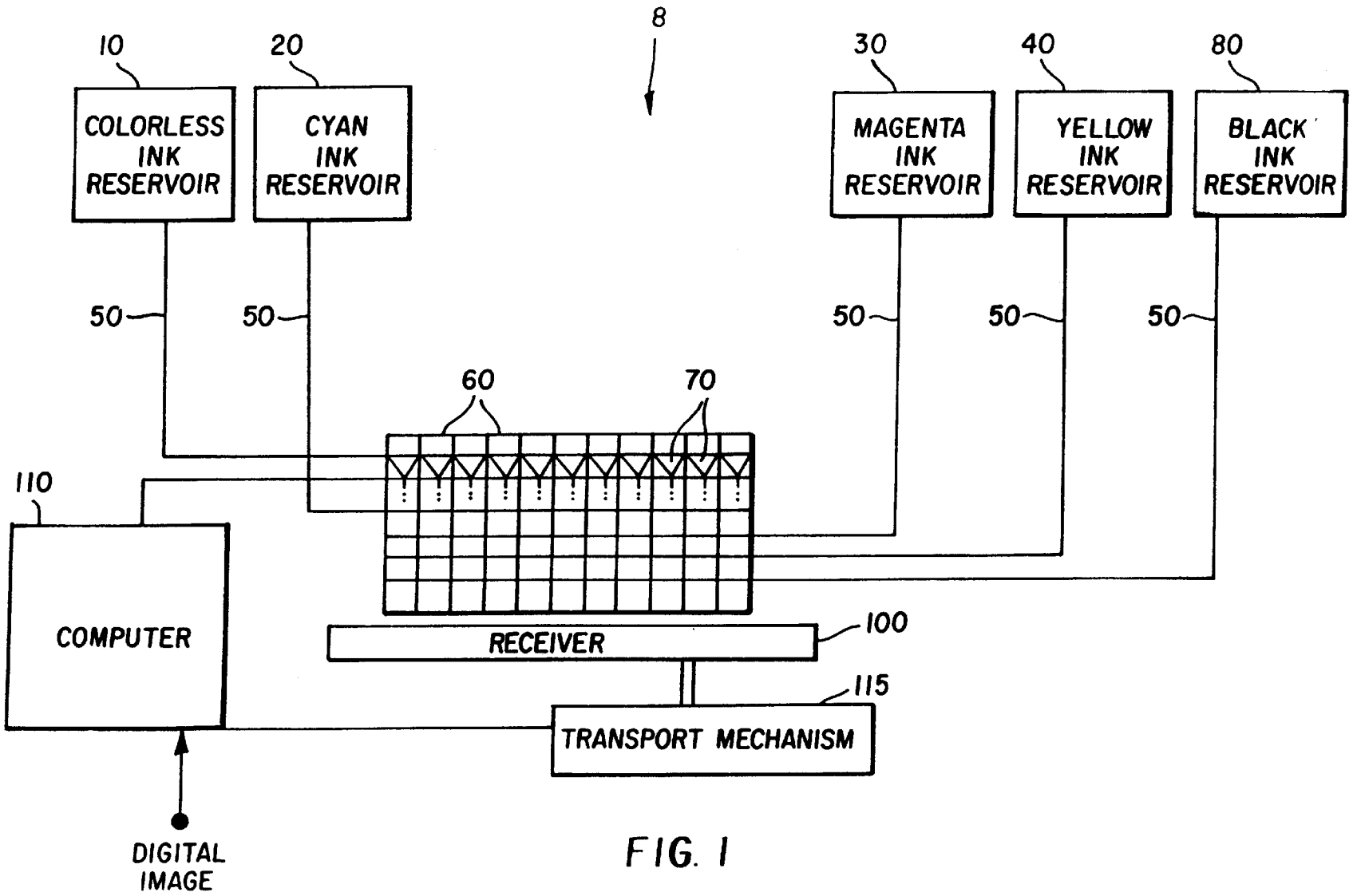
FIG. 1 is partial schematic showing a microfluidic printing system for printing a digital image on a reflective receiver.

Referring to FIG. 1, a schematic diagram is shown of a printing system 8 in accordance with the present invention. Reservoirs 20, 30, 40 and 50 are provided for respectively cyan ink, magenta ink, yellow ink and black ink. A colorless ink reservoir 10 can also be added to vary the saturation or lightness of the inks as described in the above referenced commonly assigned U.S. patent application Ser. No. 08/868,426 filed Jun. 3, 1997. A computer 110 receives or generates data representing a digital image. The computer 110 also controls the microfluidic pumps in the printing system 8 according to the data representing the digital image. Although electrokinctic pumps are illustrated in the figures of this invention, it should be understood that other kinds of microfluidic pumps may also be used such as, for example, micromechanical pumps. The computer also controls a transport mechanism 115 that conveys the receiver 100 to the printing system 8 so that colored ink pixels may be transferred to the receiver 100.

The inks used in this invention are dispersions of colorants in common solvents. In a preferred embodiment, the ink contains ionic addenda to enhance the electrical conductivity of the ink. Examples of such inks may be found is U.S. Pat. No. 5,611,847 by Gustina, Santilli and Bugner. Inks may also be found in the following commonly assigned U.S. patent application Ser. No. 08/699,955, U.S. patent application Ser. No. 08/699,962 and U.S. patent application Ser. No. 08/699,963 by McInerney, Oldfield, Bugner, Bernel and Santilli, and in U.S. patent application Ser. No. 08/790,131 by Bishop, Simons and Brick, and in U.S. patent application Ser. No. 08/764,379 by Martin. In a preferred embodiment of the invention the solvent is water. Colorants such as the Ciba Geigy Unisperse Rubine 4BA-PA, Unisperse Yellow RT-PA, and Unisperse Blue GT-PA are also preferred embodiments of the invention. The colorless ink of this invention is the solvent for the colored inks in the most preferred embodiment of the invention.

Figure 2:
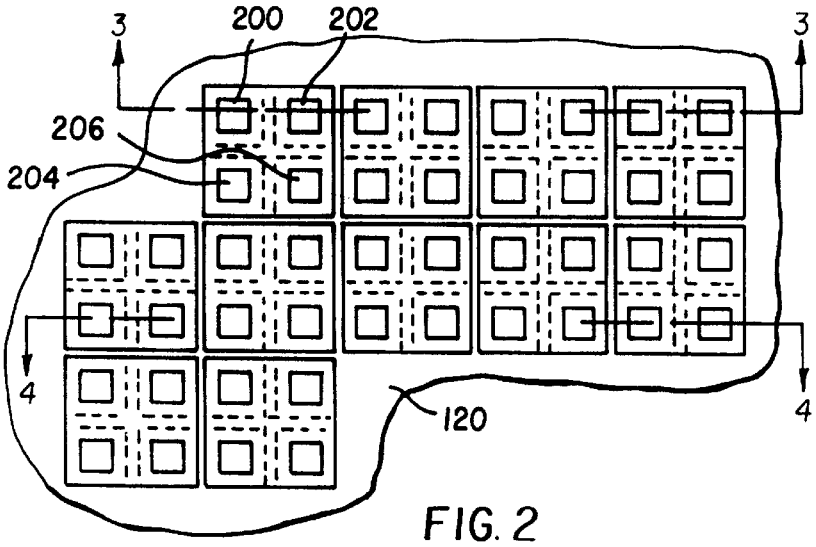
FIG. 2 is a stop view of a pattern of the color pixels which can be produced by the syst in accordance with the present invention.

FIG. 2 shows a top view of the printer front plate 120 with the colored ink orifices 200, 202, 204 and 206 which feed the ink chambers.

Figure 3:
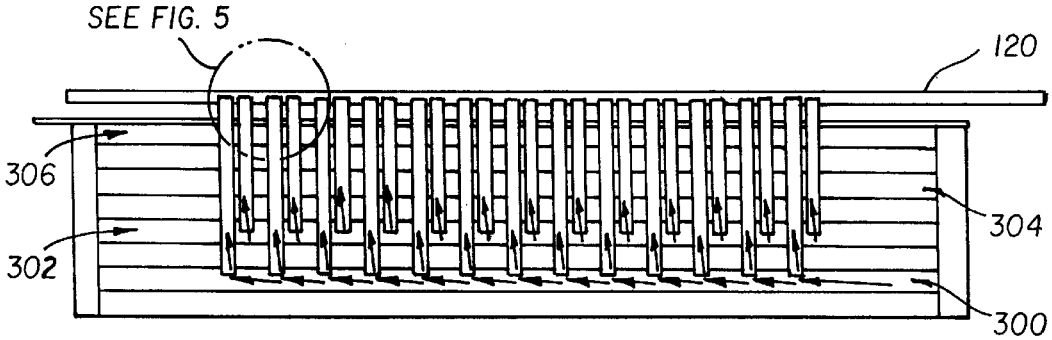
FIG. 3 is a cross-sectional view taken along the lines 3—3 of the microfluidic printing system in FIG. 2.
Figure 4:
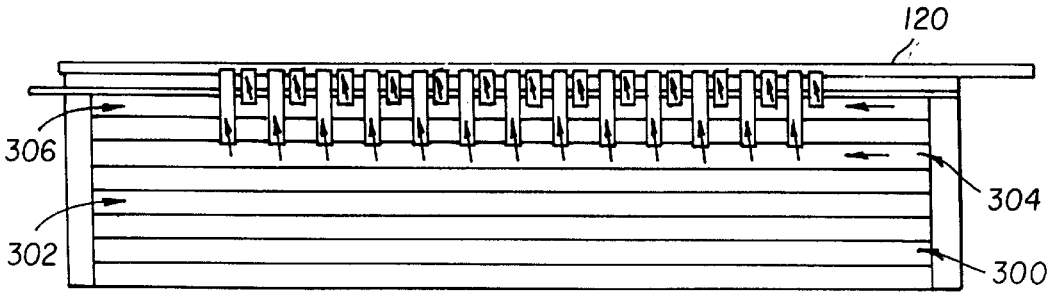
FIG. 4 is a cross-sectional view taken along the lines 4—4 of the microfluidic printing system in FIG. 2.

Cross-sections of the color pixel arrangement shown in FIG. 2 are illustrated in FIGS. 3 and 4. FIG. 3 shows a cross-sectional view across the line 3—3 in FIG. 2. The colored ink supplies 300, 302, 304 and 306 are fabricated in channels parallel to the printer front plate 120. The cyan, magenta, yellow and black inks are respectively delivered by color ink supplies 300, 302, 304 and 306 into the orifices of the printer front plate 120. FIG. 4 shows a similar cross-sectional view across the line 4—4 of FIG. 2, showing the colored ink supply lines and orifices for the other two colored inks.

The microchannel capillaries and microfluidic pumps are more fully described in the references listed above.

In the present invention, the microfluidic capillaries deliver the inks directly to a receiver; however, other types of ink delivery arrangements can be used which employ ink mixing chambers and the invention should be understood to include those arrangements. Such arrangements are described in the above cross referenced patent applications.

Figure 5:
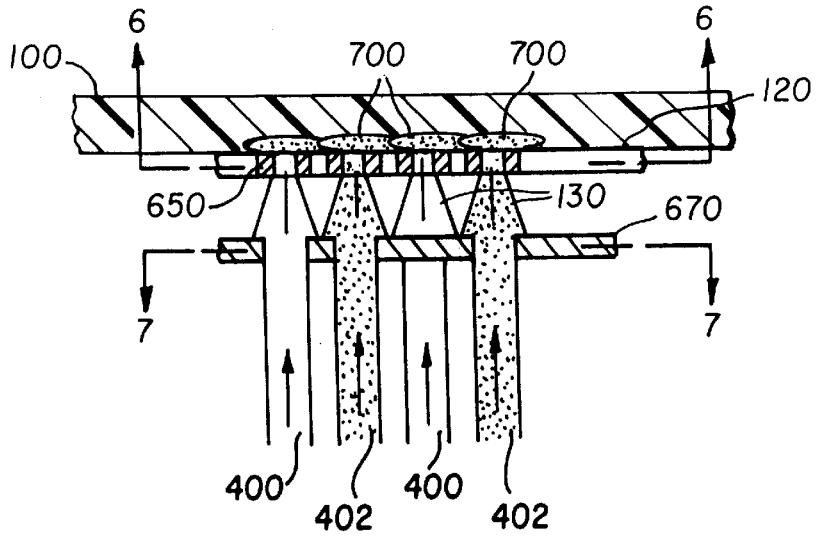
FIG. 5 is an enlarged view of the circled portion of FIG. 3.
Figure 7:
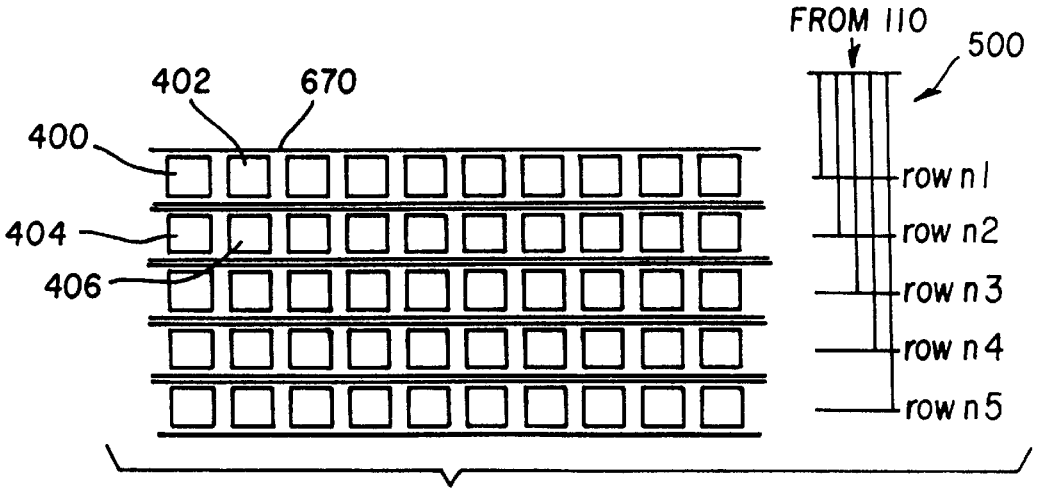
FIG. 7 is a top view of the microchannel showing the conducting circuit connections along the line 7—7 of FIG. 5.

A detailed view of the cross-section in FIG. 3 is illustrated in FIG. 5. The colored inks are delivered to the ink orifices by the electrokinetic pumps 130 through cyan, magenta, yellow and black ink microchannels 400, 402, 404 and 406 (404 and 406 are not shown in FIG. 5, but are illustrated in FIG. 7). The colored ink microchannels 400, 402, 404 and 406 are respectively connected to the colored ink supplies 300, 302, 304 and 306 (FIGS. 3 and 4). When the colored ink microchannels 400, 402, 404 and 406 are filled with ink and the receiver 100 is in contact with the printer front plate 120, the capillary force caused by the wetting of the receiver will draw or pump the ink from the microchannels. The two electrodes 650 and 670 which together constitute the electrokinetic pump 130 can used to monitor the flow of ink when activated with a high frequency alternating voltage signal from the computer 110. When the correct amount of ink has been conveyed to the receiver to provide the correct density for the colored ink pixel 700, the direction of the pump can be reversed by reversing the voltage on the electrodes to thereby stop the flow of ink to the receiver. In addition, the flow monitor signal can be used to control the voltage to the electrokinetic pump 130 so as to slow the rate of flow of ink to the receiver in order to provide better control of the color ink pixel density. It will be clear to those skilled in the art that the size of the microcapillaries 400, 402, 404 and 406 will control the rate of flow of ink to the receiver, and that the size of the microcapillary must be chosen to balance the force of the electrokinetic pump 130 for a given ink formulation.

Figure 6:
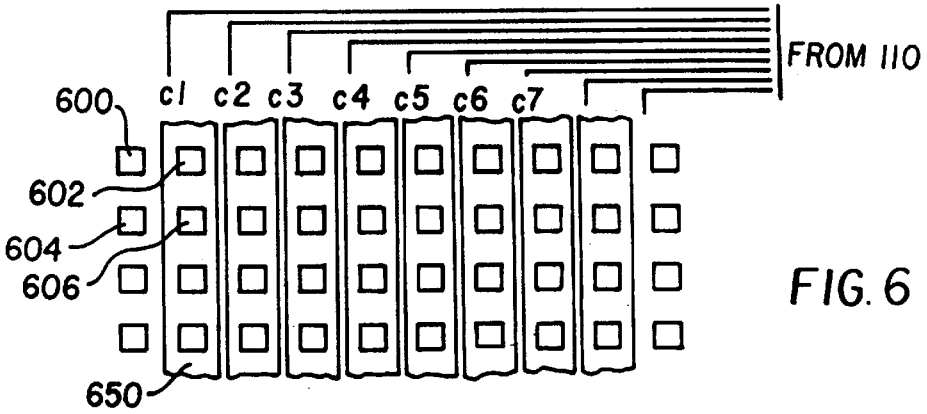
FIG. 6 is a top view of the micronozzles showing the conducting circuit connections of FIG. 5.

A top view of the plane containing the ink chambers in FIG. 5 is shown in FIG. 6. The cyan, magenta, yellow and black ink chambers 600, 602, 604 and 606 are distributed in the same arrangement as the colored ink supply lines 300–304 and electrodes 650 are shown connected to the conducting circuit 550, which is further connected to computer 110.

A top view of the plane containing the microchannels 400, 402, 404 and 406 of FIG. 5 is shown in FIG. 7. The colored ink channels 400-406 are laid out is the spatial arrangement that corresponds to those in FIGS. 2 and 6. The lower electrodes 670 in the electrokinetic pumps 130 for delivering the colored inks are shown connected to the conducting circuit 500, which is further connected to the computer 110.

Figure 8:
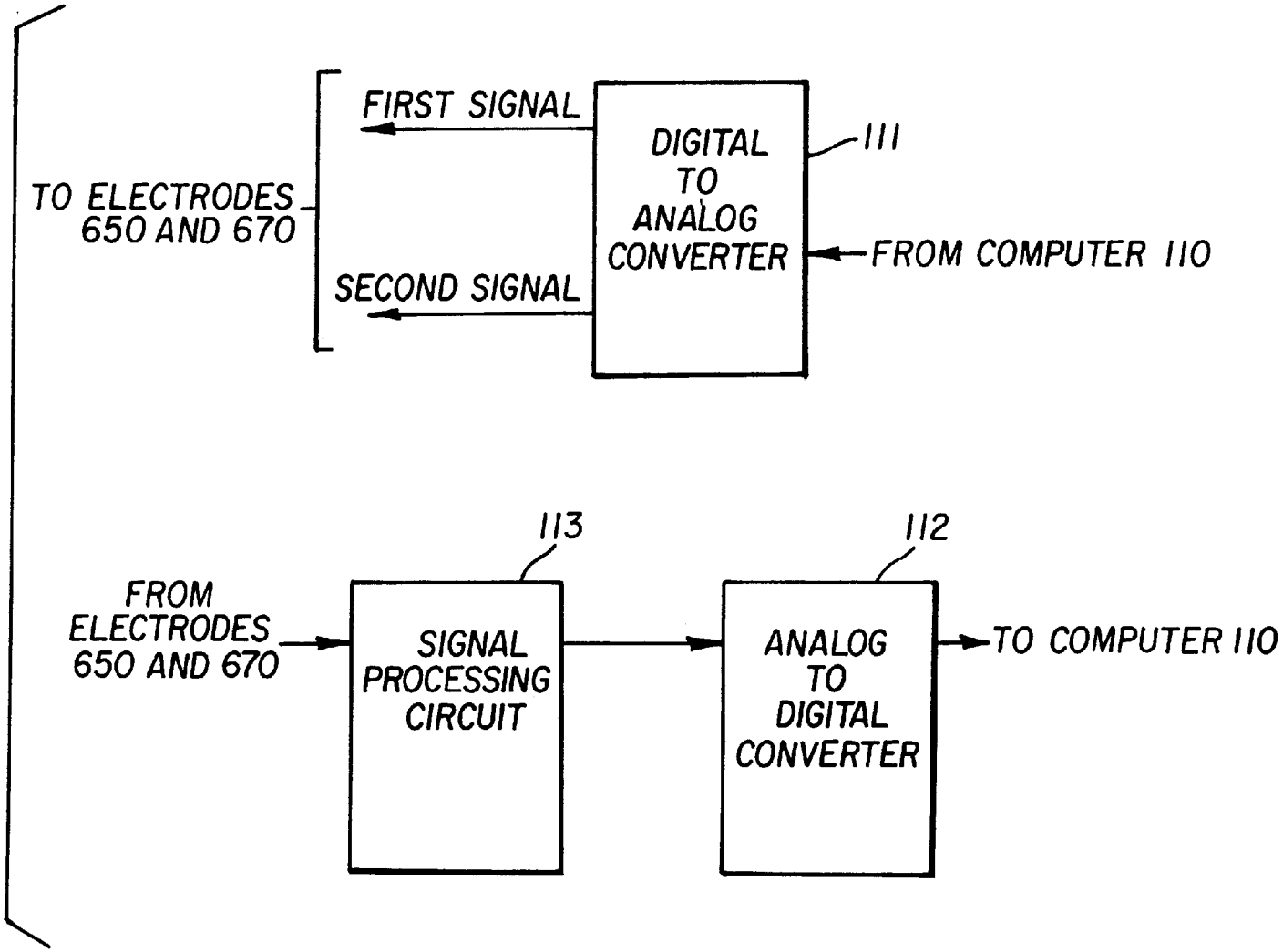
FIG. 8 is a diagram of the signal processing and control means for the electrokinetic pumps.

FIG. 8 shows a diagram for applying and receiving signals to the electrodes 650 and 670. In operation, the computer 110 provides signals to an digita-to-analog (D/A) converter 111 which sends two separate signals to the electrodes 650 and 670. The first signal causes the ink to flow and the second signal is used for measuring the flow rate of the ink. A signal processing circuit 113 is adapted to monitor the flow measuring signal. The circuit 113 also includes appropriate amplifiers. The signal from signal processing circuit 113 has a parameter varied which represents the flow of ink. More particularly, a high frequency signal can applied to the electrodes 650 and 670 for measuring the flow rate of the ink. It will be remembered that the ink includes materials that enhance conductivity. These materials can be ionic species or conductive particles. The moving conductive materials in the flowing ink between the electrodes 650 and 670 produce a voltage signal at the particular frequency for mesuring the flow rate of the ink. The voltage signal is received by the signal processing circuit 113 in which noises at other frequencies are filtered out. The signal processing circuit 113 then outputs a voltage signal whose amplitude is related to the rate of the ink flow. The signal from the signal processing circuit 113 is an analogue signal which is converted to a digital signal by the analog-to-digital converter 112. The computer then computes the amount of ink being delivered. When a desired amount is delivered, the computer 110 sends a signal to the digital-to-analog converter 111 which, in turn, sends a signal to the electrodes 650 and 670 to stop the flow of ink.

The invention has been described in detail with particular reference to certain preferred embodiments thereof, but it will be understood that variations and modifications can be effected within the spirit and scope of the invention.

Parts List

8 microfluidic printing system
10 colorless ink reservoir
20 cyan ink reservoir
30 magenta ink reservoir
40 yellow ink reservoir
50 microchannel capillaries
80 black ink reservoir
100 receiver
110 computer
111 digital-to-analogue converter
112 analogue-to-digital converter
113 signal processing circuit
115 transport mechanism
130 electrokinetic pump
120 printer front plate
200 colored ink orifices
202 colored ink orifices
204 colored ink orifices
206 colored ink orifices
300 colored ink supply lines
302 colored ink supply lines
304 colored ink supply lines
306 black ink supply
400 cyan ink microchannel
402 magenta ink microchannel
404 yellow ink microchannel
406 black ink microchannel
500 conducting circuit
550 conducting circuit
600 ink chamber
602 magenta ink chamber
604 yellow ink chamber
606 black ink chamber
650 column electrodes
670 row electrodes
700 colored ink pixels

What is claimed is:

1. A microfluidic printing system for delivering ink to a receiver comprising:

a) at least one ink reservoir, b) a structure defining a plurality of chambers arranged so tha the chambers form an array with each chamber being arranged to form an ink pixel for delivery to the receiver;

c) a plurality of microchannels connecting said at least ink reservoir to the chambers;

d) a plurality of microfluidic pumps each being associated with a single microchannel of said plurality of microchannels for supplying ink from said at least one ink reservoir though a microchannel of said plurality of microchannels for delivery to a particular chamber of said plurality of chambers, each pump including a least two spaced apart electrodes and means coupled to the electrodes for producing an electrical field in response to an input voltage that act upon the ink to control or prevent an ink flow;

e) means responsive to the flow of ink for providing a flow measuring signal to the electrodes and means responsive to variations in a signal parameter of the applied signal across the electrodes for measuring the flow of the ink through the chambers to determine a correct around of ink being delivery to the receiver through the chambers; and f) means couple to the ink flow responsive means for controlling the microfluidic pumps to prevent a further flow of ink the receiver.

2. A microfluidic printing system for delivering ink having conductor material to a receiver comprising:

a) at least one ink reservoir;

b) a structure defining a plurality chambers arranged so that the chambers form an array with each chamber being arranged to form a conductive ink pixel for delivery to the receiver;

c) a plurality of microchannels connecting said at least one ink reservoir to the chambers;

d) a plurality of microfluidic pumps each being associated with a single microchannel of said plurality of microchannels for supplying conductive ink from said at least one ink reservoir through a microchannel of said plurality of microchannels for delivery to a particular chamber of said plurality of chambers, each pump including at least two spaced apart electrodes which produce an electric field in response to an input voltage that act upon the conductive ink to control or prevent an ink flow;

e) means for providing a high frequency flow measuring signal to the electrodes and means responsive to variations in the signal applied across the electrodes for measuring the flow of the conductive ink through the chambers to determine a correct amount of conductive ink being, delivered to the receiver through the chambers; and f) flow control means including a source of DC voltage and means f or applying the DC voltage applied across the electrodes of each microfluidic pump of plurality of microfluidic pumps in a first direction for causing the ink to flow through the chambers to the receiver and, in a second direction, for preventing the ink flow to the receiver; such flow control means being coupled to the ink flow responsive means for causing the DC voltage to be applied in the second direction to prevent a further flow of ink to the receiver when the correct amount of ink is delivered to the receiver.

* * * * *

UNITED STATES PATENT AND TRADEMARK OFFICE

CERTIFICATE OF CORRECTION

PATENT NO. : 5,982,401
DATED : November 9, 1999
INVENTOR(S) : Werner Fassler, et al It is certified that error appears in the above-identified patent and that said Letters Patent is hereby corrected as shown below:

| | |
|---|---|
| Claim 1, line 8 | after "connecting said at least" insert --one-- |
| Claim 1, line 13 | delete "though" and substitute with --through-- |
| Claim 1, line 17 | delete "electrical" and substitute with --electric-- |
| Claim 1, line 25 | delete "around" and substitute with --amount-- |
| Claim 1, line 27 | delete "couple" and substitute with --coupled-- |
| Claim 2, line 29 | after "microfluidic pump of" insert --said-- |

Signed and Sealed this

Eleventh Day of July, 2000

*Attest:*

Q. TODD DICKINSON

*Attesting Officer*

*Director of Patents and Trademarks*